US006263529B1

(12) United States Patent
Chadwick et al.

(10) Patent No.: US 6,263,529 B1
(45) Date of Patent: Jul. 24, 2001

(54) CUBICLE BED HAVING TRANSPARENT, MINIMALLY RESTRICTIVE BARRIERS

(75) Inventors: Daniel Chadwick, Martin, TN (US); Mitchell G. Alexander, 6733 21st Way, South, St. Petersburg, FL (US) 33712

(73) Assignee: Mitchell G. Alexander, St. Petersburg, FL (US)

( * ) Notice: Subject to any disclaimer, the term of this patent is extended or adjusted under 35 U.S.C. 154(b) by 0 days.

(21) Appl. No.: 09/235,753

(22) Filed: Jan. 25, 1999

Related U.S. Application Data

(60) Provisional application No. 60/072,874, filed on Jan. 28, 1998.

(51) Int. Cl.[7] ..... A47C 21/08

(52) U.S. Cl. ..... 5/414; 5/424; 5/425

(58) Field of Search ..... 5/414, 424, 425, 5/8, 98.1, 512, 113, 416, 418; 135/96

(56) References Cited

U.S. PATENT DOCUMENTS

| | | | | |
|---|---|---|---|---|
| 1,056,712 | * | 3/1913 | Schweda | 5/414 |
| 2,047,056 | * | 7/1936 | Brown | 135/96 |
| 2,301,511 | * | 10/1942 | Boyce | 5/113 |
| 3,763,507 | * | 10/1973 | Propst | 5/512 X |
| 4,641,387 | | 2/1987 | Bondy et al. | 5/508 |
| 4,953,246 | | 9/1990 | Matthews | 5/424 |
| 5,359,740 | | 11/1994 | Markley et al. | 5/425 |
| 5,384,925 | * | 1/1995 | Vail | 5/414 X |
| 5,561,874 | | 10/1996 | Malofsky et al. | 5/99 |
| 5,784,732 | * | 7/1998 | Vail | 5/424 X |

* cited by examiner

*Primary Examiner*—Terry Lee Melius
*Assistant Examiner*—Fredrick Conley
(74) *Attorney, Agent, or Firm*—James C. Lydon

(57) ABSTRACT

A cubicle bed, including a horizontal non-steel bed frame having a rectangular perimeter including a head end, a foot end parallel to the head end, and two parallel sides between the head end and the foot end; the frame adapted to support a bed mattress; a footboard extending vertically from the foot end, and including a non-steel footboard frame supporting a substantially transparent mesh panel; a headboard extending vertically from the head end, and including a non-steel headboard frame supporting a substantially transparent mesh panel; a pair of opposed sideboards extending vertically from the parallel sides, each of the sideboards including a non-steel sideboard frame supporting a substantially transparent mesh panel, with at least one of the substantially transparent mesh panels being releasably attached to the sideboard frame; the footboard, headboard and sideboards being joined together in cooperating relationship to define a barrier about the perimeter of the horizontal bed frame.

6 Claims, 4 Drawing Sheets

Fig. 1
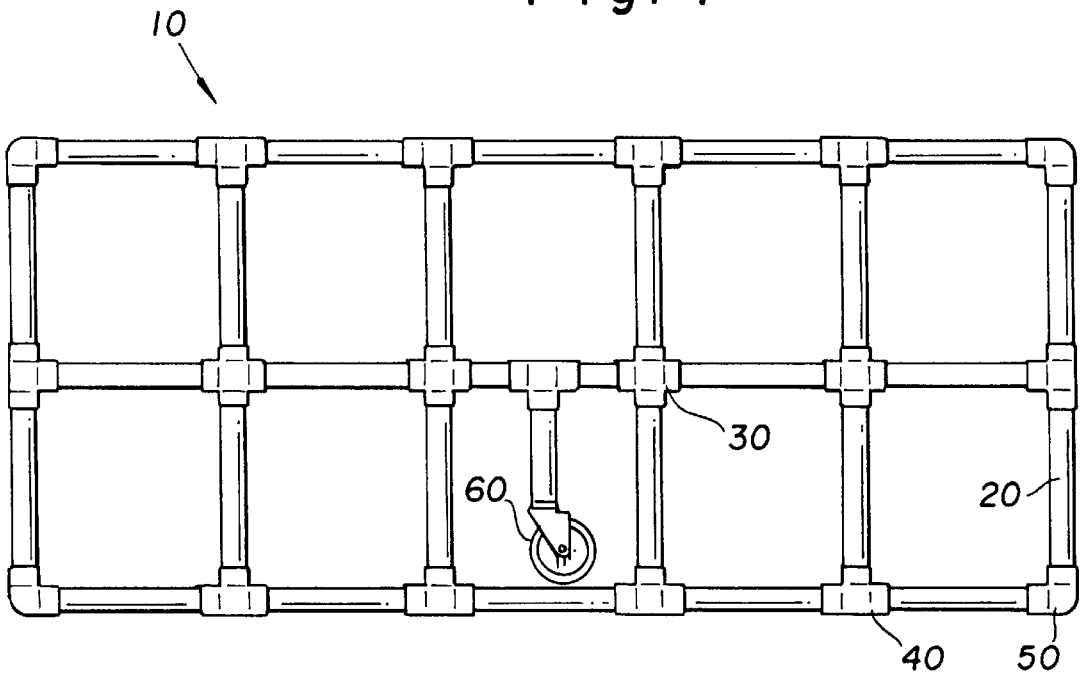
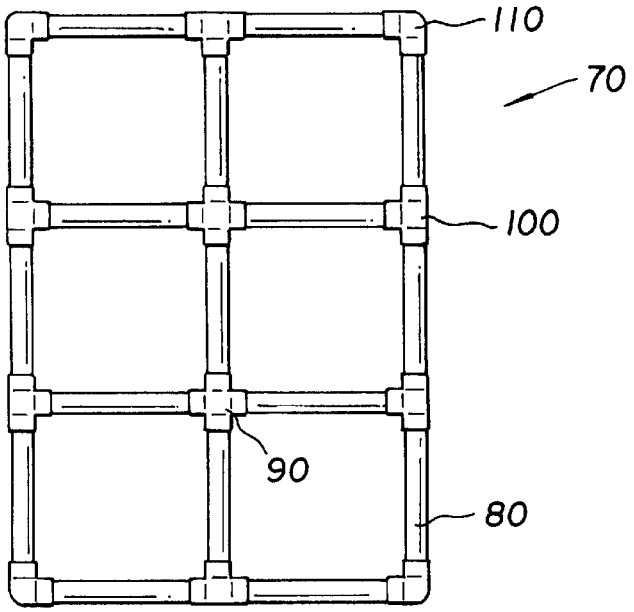
Fig. 2

CUBICLE BED HAVING TRANSPARENT, MINIMALLY RESTRICTIVE BARRIERS

This Application claims priority of Provisional Application Ser. No. 60/072,874filed Jan. 28, 1998 now abandoned.

This invention relates to an improved cubicle bed for patients who may injure themselves if they are not physically or medicinally restrained.

BACKGROUND OF THE INVENTION

Hospital beds are well known, and typically include a mattress supported by a steel frame, which may have a wheeled base, and may have means for raising a portion of the mattress above its horizontal plane. Such hospital beds may also possess a set of guardrails which may be moved from a low position below the plane of the mattress to a high position above the mattress plane in order to prevent a sedated patient from inadvertently falling from the bed onto the hospital floor.

Patients recuperating from brain injuries or suffering from Alzheimer's disease or dementia can experience confusion and agitation. These patients can injure themselves by leaving their beds unassisted. The conventional hospital bed, even with raised guardrails, is not a satisfactory solution to this problem because it is not designed to restrain a patient who is actively attempting to leave his bed.

It is of course possible to physically and/or medicinally restrain a patient to a bed. However, such restraint precludes the patient from moving about and changing position. Moreover, physical restraints can cause emotional problems and put strain on the patient and the hospital staff. Similarly, medicinal restraints can increase patient confusion and delay recovery time. See generally, Williams et al, "The Emory Cubicle Bed: An Alternative to Restraints for Agitated Traumatically Brain Injured Clients", 15 *Rehabilitation Nursing* 30 (1990).

U.S. Pat. No. 4,953,246 discloses a cubicle bed for protectively confining a traumatically brain injured patient. The cubicle bed includes a two part rectangular base having a padded upper surface atop which the patient rests, and also includes removable upright padded end panels connectable to each end of each part of the base, and pivotably openable and removable side doors. The end panels and doors, when in place and closed, form a fully padded perimeter wall around the edges of the base which are sized in height above the base so that the patient's view of the surrounding activity outside the cubicle bed is limited.

U.S. Pat. No. 5,359,740 discloses a patient restraint bed having a mattress and a vertical wall extending about the entire periphery of the mattress. The wall includes lightweight panels disposed in one or more courses. A gate is provided in one section of the wall by gate panels hingedly mounted at one end and latchably mounted at an opposite end. Panels other than gate panels are rigidly mounted in place with respect to one another. Each panel has a rigid structural exterior section and an interior padded section. The padded sections are disposed so that padding is provided over substantially the entire interior side of the wall when the panels are assembled in the walls.

Cubicle beds having padded walls address some of the problems raised by physical/medicinal restraint of agitated and brain injured patients. However, such cubicle beds create additional problems in that their padded walls make visual monitoring of the patient difficult, and may make the patient feel isolated and even claustrophobic.

U.S. Pat. No. 4,641,387 discloses a bed enclosure which is formed of a supporting framework and an associated covering provided with suitably arranged zippered areas for providing access to the patient from the exterior of the enclosure. However, the enclosure requires the use of a separate and conventional hospital bed. The bed/enclosure combination suffers from several disadvantages. First, the enclosure must be closely sized to the bed's outside dimensions to preclude the possibility of the patient's extremities (arms, legs, and even head) entering and possibly becoming stuck in a space between the bed and the enclosure. Second, the bed/enclosure combination may not be easily transportable as a unit, or even require disassembly prior to transporting a patient from one room to another within the hospital.

U.S. Pat. No. 5,561,874 discloses a child and infant enclosure structure comprised of tubing sections of lightweight, high modulus, fiber reinforced plastic matrix composite.

An object of the present invention is to provide a cubicle bed which will safely prevent a patient from leaving, yet not physically restrain the patient to a single position.

Another object of the invention is to provide a cubicle bed which permits easy visual monitoring of the patient.

Yet another object of the invention is to provide an improved cubical bed which permits rapid access to patients who require medical care, and which reduces the need for one-on-one patient supervision.

A feature of the invention is a cubicle bed having a sturdy, non-steel frame which is lightweight and non-corrosive, and which can be easily cleaned.

Another feature of the invention is a substantially transparent mesh panel attached to the frame which prevents patient egress but permits convenient patient monitoring by a caregiver.

Still another feature of the invention is a rapidly releasible attachment for securing the substantially transparent mesh panel to the non-steel frame, thereby permitting prompt medical attention to be provided to the patient.

An advantage of the present invention is the ability to rapidly and safely transport the cubicle bed with a patient inside. Additional advantages include economical and lightweight construction, and easy maintenance.

BRIEF SUMMARY OF THE INVENTION

The present invention relates to a cubicle bed which includes a) a horizontal, non-steel bed frame having a rectangular perimeter including a head end, a foot end parallel to the head end, and two parallel sides between the head end and the foot end; the bed frame adapted to support a bed mattress;

b) a footboard extending vertically from the foot end, and including a non-steel footboard frame supporting a substantially transparent mesh panel;

c) a headboard extending vertically from the head end, and including a non-steel headboard frame supporting a substantially transparent mesh panel;

d) a pair of opposed sideboards extending vertically from the parallel sides, each of the sideboards including a non-steel sideboard frame supporting a substantially transparent mesh panel, with at least one of the substantially transparent mesh panels being releasably attached to said sideboard frame;

the footboard, headboard and sideboards being joined together in cooperating relationship to define a barrier about the perimeter of the horizontal bed frame.

BRIEF DESCRIPTION OF THE DRAWINGS

FIG. 1 is a view of the bottom, horizontal bed frame of the cubicle bed of the present invention.

FIG. 2 is a view of the footboard frame of the cubicle bed of the present invention.

DETAILED DESCRIPTION OF THE PREFERRED EMBODIMENTS

Figure 3:
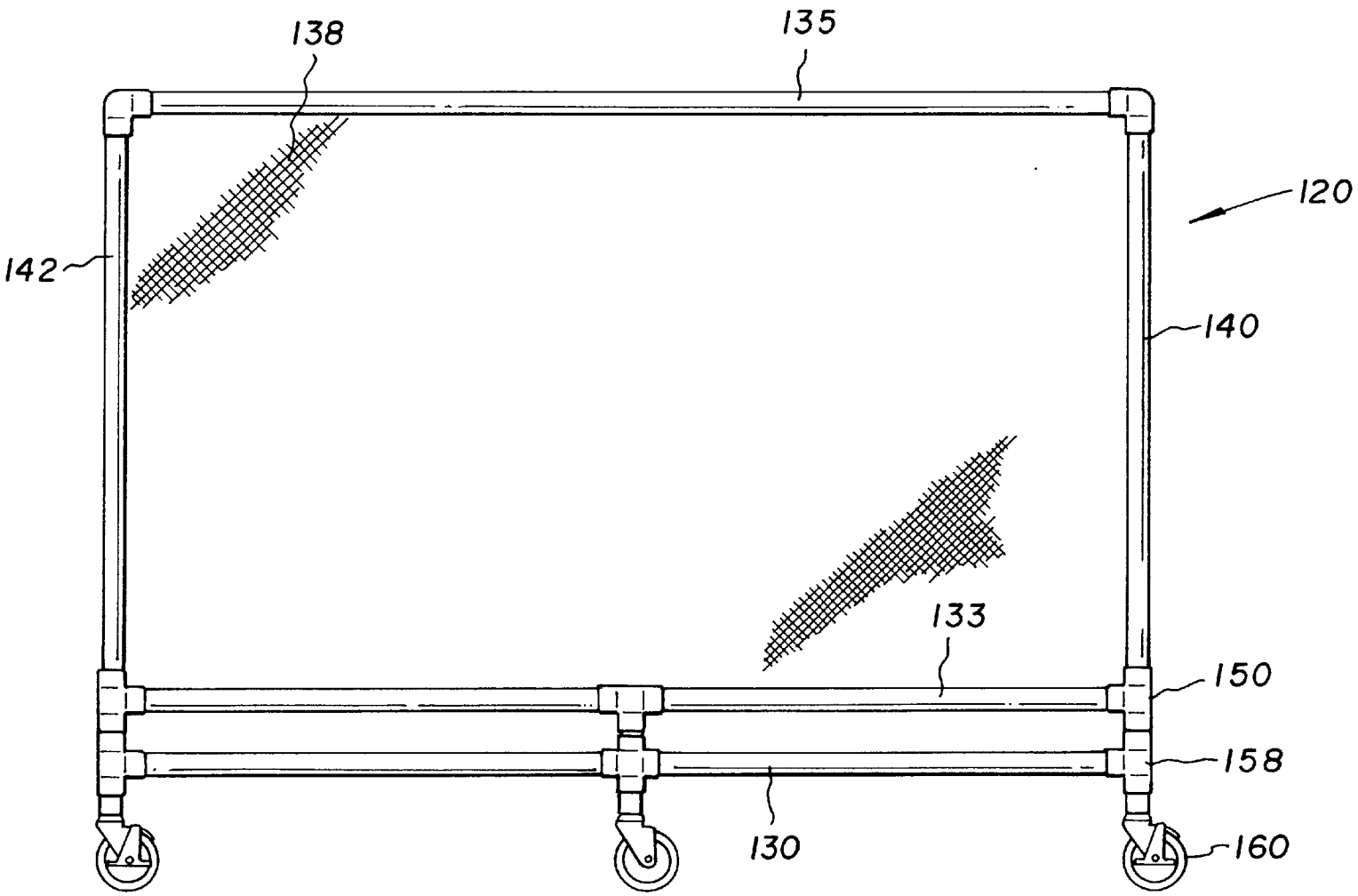
FIG. 3 is a view of the sideboard frame of the cubicle bed of the present invention.

The cubicle bed of the present invention safely confines a patient to a cubicle defined by a substantially transparent mesh or netting which is supported by a sturdy, non-steel perimeter frame. The cubicle should be sufficiently high that a patient placed inside will be effectively confined therein without the necessity of physical and/or medicinal restraint.

By "substantially transparent mesh" it is meant that a caregiver can readily observe a patient through the mesh in sufficient detail to observe his position and outward appearance. The mesh must be sufficiently transparent that a care-giver can easily discern whether a patient confined in the cubicle bed is sleeping, awake, lying down or sitting, or looks ill, without having to closely approach the mesh to peer through or over it, allowing visual evaluation from all sides.

The substantially transparent mesh panels may be formed of synthetic filament having a high tensile strength. Suitable synthetic mesh includes nylon, polyester, polyetheretherketone, and other high performance engineering fabrics. Nylon mesh is preferred due to its lightweight, durability, ease of cleaning and for patient comfort considerations. The panels are sized to correspond to the length and width of the footboard, sideboards, headboard, and horizontal bed frame which make up the perimeter frame to which the panels are attached.

The substantially transparent mesh panel may be attached to the bed frame using any conventional fastening device which will insure that a patient cannot remove the mesh and thereby exit the cubicle bed. For example, the mesh panel may be screwed or stapled in place. Alternatively, one edge of a vinyl border may be sewn onto the perimeter of the mesh panel, with the other edge of the vinyl border permanently secured to the bed framework, for example by grommets bolted into place on the bed frame.

The horizontal bed frame has a rectangular perimeter comprising a head end, a foot end parallel to the head end, and two parallel sides between the head end and the foot end, and is adapted to support a conventional mattress. The horizontal bed frame may be of any construction which is sufficiently strong to support the patient's weight and that of the associated headboard, footboard and sideboards of the bed, and which will prevent patient egress through the bed bottom.

The materials used to construct the horizontal bed frame, footboard, headboard and sideboard should not be made of steel due to its weight and tendency to rust. Instead, the cubicle bed frame is preferably made of plastic pipe, most preferably lightweight, durable PVC pipe which is commercially available and which may be cut to desired lengths. One or more of these frames may be made from other non-steel materials such as wood or aluminum. However, these materials are nonpreferred due to weight and cleaning considerations.

FIG. 1 shows a preferred embodiment of the bed frame 10 formed of a plurality of short lengths of plastic pipe 20 joined to one another by connecting means such as crosses 30, tees 40 and elbows 50. A substantially transparent mesh panel (not shown) which has substantially the same width and length as the bed frame is secured to the top surface of the frame 10 to further ensure that the patient cannot exit the cubicle from the bottom of the bed. Wheels 60 may be operatively joined to the bottom of the bed frame 10.

The footboard extends vertically from the foot end of the horizontal bed frame, and should be sufficiently strong to restrain a patient seeking to exit the cubicle bed via its foot end. The footboard frame is joined to the horizontal bed frame by conventional fasteners such as bolts, and supports a substantially transparent mesh panel, which has substantially the same width and height as the footboard frame. The substantially transparent mesh panel is securely attached to the frame of the footboard by conventional fasteners, such as, for example, finishing screws or staples. FIG. 2 illustrates a preferred embodiment of a footboard frame, in which footboard 70 may be formed of a plurality of short lengths of plastic pipe 80 joined to one another by connecting means such as crosses 90, tees 100 and elbows 110.

The headboard extends vertically from the head end of the horizontal bed frame, and should be sufficiently strong enough to restrain a patient seeking to exit the cubicle bed via its head end. The construction of the headboard frame may be substantially identical to that of the footboard frame. The headboard frame may be joined to the horizontal bed frame using conventional fasteners such as bolts, and supports a substantially transparent mesh panel which has substantially the same width and height as the headboard frame. The transparent mesh panel is securely attached to the headboard framework by conventional fasteners, such as, for example, staples or finishing screws.

Sideboards extend vertically from both parallel sides between the head end and the foot end of the horizontal bed frame, and should be sufficiently strong enough to restrain a patient seeking to exit the cubicle bed via the parallel side. The sideboard frames are each joined to the horizontal bed frame, and also to the foot and head boards, using conventional fasteners, such as, for example, bolts, and each supports a substantially transparent mesh panel which has substantially the same width and height as the sideboard frames.

At least one, and preferably both, of the sideboards must permit rapid access/entry to the cubicle bed so that a patient confined within the bed cubicle may receive prompt medical attention. Rapid access and entry are achieved by releasably attaching the transparent netting or mesh to the sideboard frame, for example, by zippers, snaps or velcro strips. Zippers are especially preferred because they provide a stronger, more rapid release and attachment. If a vinyl border is provided, the zipper can releasably join two portions of the border together, with one border portion being permanently connected to the sideframe and the other border portion being permanently connected to the transparent mesh.

FIG. 3 shows a preferred embodiment of the sideboard. The sideboard 120 is formed of a plurality of horizontal lengths of plastic pipe 130, 133 and 135 joined to one another by vertical lengths of plastic pipe 140 and 141 by connecting means such as tees 150 and 158. A substantially transparent mesh panel 138 is permanently secured to horizontal pipe 133 by conventional means such as finishing screws or staples. The transparent mesh panel 138 is releasably attached to the vertical pipes 140, 141 and horizontal pipe 135 by a zipper (not shown). Wheels 160 are operatively joined to the bottom of sideboard frame 120.

A patient may be placed in the cubicle bed by first releasing (unzipping) the transparent mesh panel from the vertical pipes 140, 141 and horizontal pipe 135, thereby permitting entry into the cubicle. Once the patient is entirely within the cubicle, the transparent mesh panel 138 is then refastened to the vertical pipes 140, 141 and to horizontal pipe 135 by closing (rezipping) the zipper.

Figure 4:
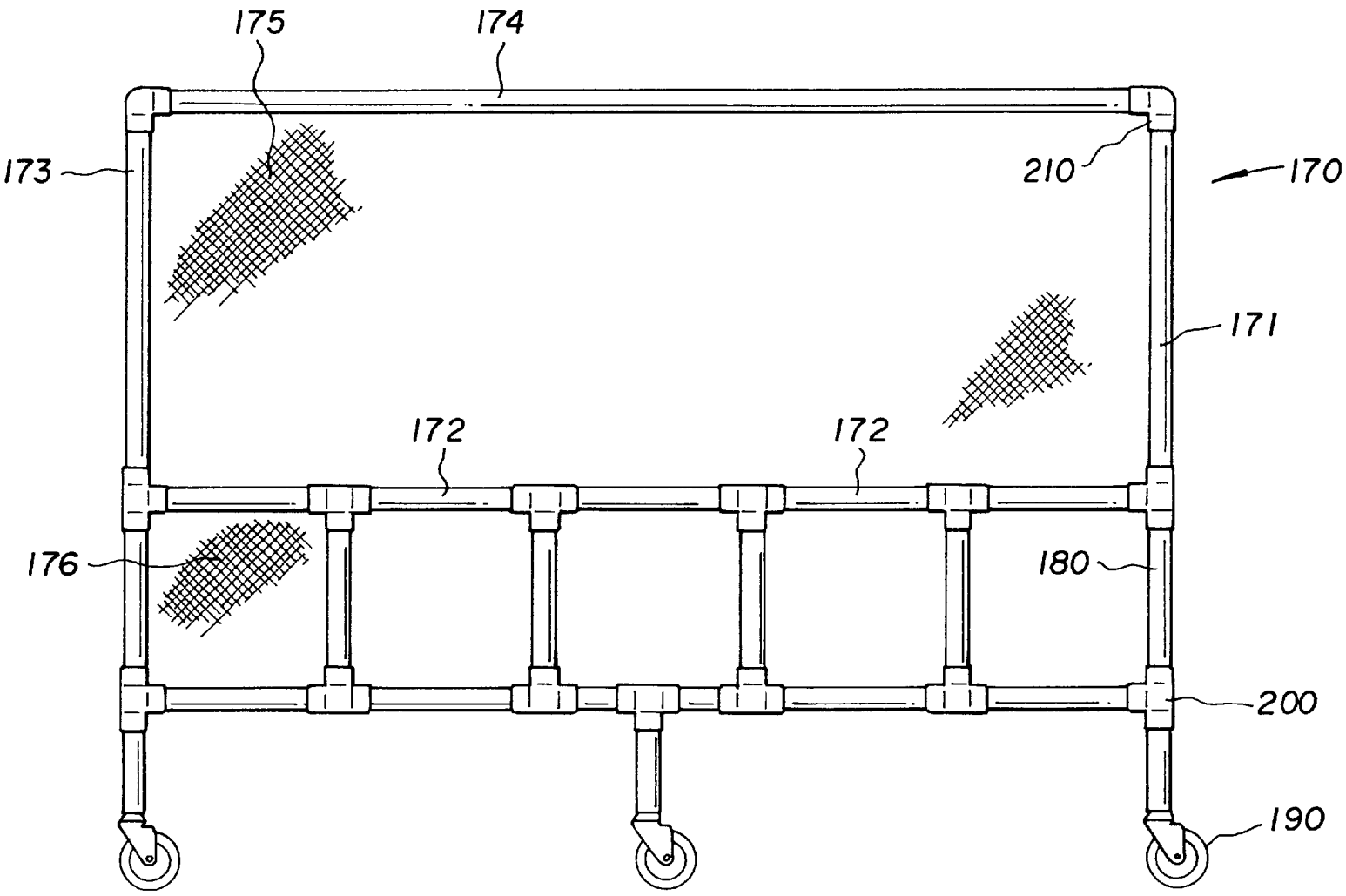
FIG. 4 is a view of another embodiment of the sideboard frame of the cubicle bed of the present invention.

FIG. 4 illustrates another embodiment of the sideboard frame in which a smaller access area is provided to allow medical care but not patient entry or exit. Sideboard frame 170 is formed of a plurality of short lengths of plastic pipe 180 joined to one another by connecting means such as tees 200 and elbows 210. A substantially transparent mesh panel 176 is permanently secured to the interior lower one third of the framework by conventional fasteners such as finishing screws. A substantially transparent mesh panel 175 is releasably secured to the exterior upper two-thirds of the back sideboard, for example by zippers. The substantially transparent mesh panel is attached to a vinyl border that is permanently secured to vertical pipes 171, 173 and horizontal pipes 172 and 174. Wheels 190 are operatively joined to the bottom of back sideboard frame 170.

Patient entry and withdrawal is achieved by releasing and removing the transparent mesh or netting from one of the sideboards of the cubicle bed. Accordingly, the sideboard illustrated in FIG. 4 could not be used on both sides of the same bed because the area of releasable transparent mesh is too small to permit convenient entry and exit of the patient. Instead, the sideboard of FIG. 4 would be considered a "back" sideboard, and used in conjunction with the sideboard of FIG. 3 as the "front" sideboard which would permit entry and exit of the patient.

A canopy restraint may be removably attached to the top edges of the headboard frame, footboard frame, and sideboard frames to provide a totally enclosed cubicle. The canopy restraint may comprise a substantially transparent mesh panel, and may be releasably attached to the upper edges of the cubicle bed by conventional fasteners, such as, zippers, snaps and velcro.

Padded panels may be optionally mounted on one or more of the interior surfaces of the substantially transparent mesh, except for the "front" sideboard. The padded panels should generally conform to the dimensions of the frames to which they are to be attached. Thus, a padded panel for the footboard should have a length and width which is closely approximate to those of the footboard, but which take into account the dimensions of any adjacent padded panel mounted on a "rear" sideboard.

The padded panels may comprise foam padding covered by a non-porous, easily cleaned outer surface or skin. Provision may be made for removal of the foam padding from the outer covering. The padded panel may include grommets or other conventional fasteners to ensure that the panels are securely mounted to the frames of the cubicle bed. Obviously, the padded panel will render the walls of the cubicle bed all or partially opaque, thereby limiting visual monitoring of the patient to the front side of the bed. However, padded panels may be desired for patient comfort and protection.

Figure 5:
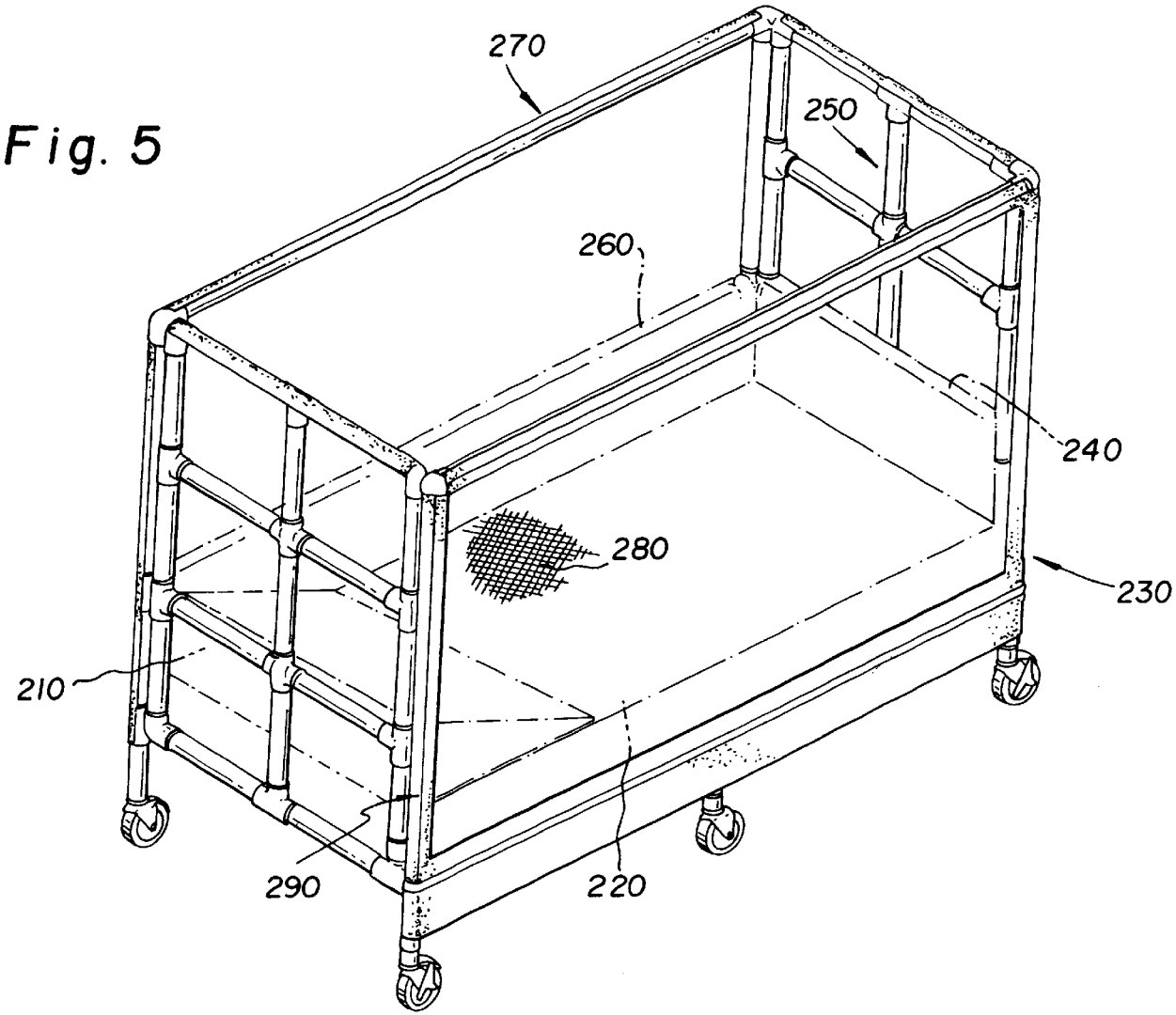
FIG. 5 is a plan view of the cubicle bed of the present invention.

FIG. 5 illustrates a preferred embodiment of the cubicle bed which is fitted with means for elevating a portion of the patient from the horizontal position. Wedge pillow 210 may be placed on the mattress 220 of the bed 230 in order to elevate a patient's head above his feet, or vice versa. A padded panel 240 is attached to footboard 250, and another panel 260 is attached to "rear" sideboard 270. Rapid and complete access to a patient is provided by the "front" sideboard, which does not have a padded panel, and whose transparent mesh 280 is releasably attached to the sideboard frame 290.

The cubicle bed of the present invention will effectively confine a patient without the problems associated with physical and medicinal restraint. Its transparent mesh allows convenient visual monitoring of a patient confined therein, while the releasable mesh attachment of the side boards provide (1) patient entry and withdrawal, (2) rapid access to the patient's entire body, and (3) adequate access space for medical personnel to provide care to the patient. The cubicle bed has a simple construction which is easy to clean and maintain.

The cubicle bed also overcomes the problems associated with bed/enclosure combinations, such as excess space between the bed and the enclosure and the lack of mobility of the bed/enclosure as a unit.

What is claimed is:

1. A cubicle bed, comprising a) a horizontal, non-steel bed frame having a rectangular perimeter comprising a head end, a foot end parallel to said head end, and two parallel sides between said head end and said foot end, said frame adapted to support a bed mattress;

b) a footboard extending vertically from said foot end, and comprising a non-steel footboard frame supporting a substantially transparent mesh panel;

c) a headboard extending vertically from said head end, and comprising a non-steel headboard frame supporting a substantially transparent mesh panel;

d) a pair of opposed sideboards extending vertically from said parallel sides, each of said sideboards comprising a non-steel sideboard frame supporting a substantially transparent mesh panel, with at least one of the substantially transparent mesh panels being releasably attached to said sideboard frame;

said footboard, headboard and sideboards being joined together in cooperating relationship to define a barrier about said perimeter of said horizontal bed frame, wherein at least one of said horizontal bed frame, said footboard frame, said headboard frame and said sideboard frames are formed of lengths of pipe joined to one another by crosses, tees and elbows, wherein corners of said at least one frame are defined by elbows joined to two pipe lengths which are substantially perpendicular to one another;

sides of said at least one frame are defined by opposing corners which are connected together by a plurality of lengths of pipe in co-axial relationship and joined to one another, except at said corners, by tees having a third joint facing towards an interior of said at least one frame; and said third joints are joined to one another by a plurality of lengths of pipe which are themselves joined together by a plurality of crosses.

2. The bed of claim 1, further comprising a canopy restraint removably attached to said headboard, footboard and sideboard frames.

3. The bed of claim 1, further comprising a wheeled base operatively attached to said horizontal bed frame and said sideboard frames.

4. The bed of claim 1, further comprising at least one padded panel mounted on at least one member of the group consisting of a footboard, a headboard and a sideboard, with the proviso that a padded panel cannot be mounted on both sideboards.

5. The bed of claim 1, wherein said substantially transparent mesh panel comprises nylon.

6. The bed of claim 1, further comprising a vinyl border having two portions, with one border portion being permanently connected to said sideframe and the other border portion being permanently connected to said transparent mesh, and said two border portions being releasably joined together by a zipper.

* * * * *